US010045580B2

(12) United States Patent
Choi

(10) Patent No.: US 10,045,580 B2
(45) Date of Patent: Aug. 14, 2018

(54) HAIR ROLL-UP PACKAGE

(71) Applicant: Sun Taiyang Co., Ltd., Moonachi, NJ (US)

(72) Inventor: Louis Choi, Moonachie, NJ (US)

(73) Assignee: Sun Taiyang Co., Ltd., Moonachie, NJ (US)

( * ) Notice: Subject to any disclaimer, the term of this patent is extended or adjusted under 35 U.S.C. 154(b) by 0 days.

(21) Appl. No.: 15/090,148

(22) Filed: Apr. 4, 2016

(65) Prior Publication Data

US 2016/0295945 A1 Oct. 13, 2016

Related U.S. Application Data

(60) Provisional application No. 62/145,256, filed on Apr. 9, 2015.

(51) Int. Cl.
*A41G 5/00* (2006.01)

(52) U.S. Cl.
CPC ..... *A41G 5/0046* (2013.01)

(58) Field of Classification Search
CPC ..... A45C 11/02; A45C 11/00; B65D 85/18; B65D 5/5097; A42B 1/18
USPC ..... 206/278, 8; 132/53, 54, 201, 246
See application file for complete search history.

(56) References Cited

U.S. PATENT DOCUMENTS

| | | | | |
|---|---|---|---|---|
| 289,957 | A * | 12/1883 | Baxter | A41G 3/0075 132/201 |
| 5,722,434 | A * | 3/1998 | Walker | A41G 5/0073 132/201 |
| D644,426 | S * | 9/2011 | Skaggs | D3/205 |
| 8,439,237 | B2 | 5/2013 | Choi | |
| 8,695,792 | B2 | 4/2014 | Choi | |
| 8,800,827 | B2 | 8/2014 | Choi | |
| 9,161,607 | B2 | 10/2015 | Choi | |
| 9,198,476 | B1 * | 12/2015 | Kim | B65B 5/04 |
| 9,220,329 | B1 * | 12/2015 | Kim | A45C 11/00 |
| 2003/0159962 | A1 * | 8/2003 | Heo | B65D 73/0071 206/461 |
| 2005/0268932 | A1 * | 12/2005 | Gold | A41G 5/0046 132/201 |
| 2009/0165810 | A1 * | 7/2009 | Sotokawa | A41G 3/00 132/54 |
| 2012/0118315 | A1 * | 5/2012 | Goff | A41G 5/008 132/201 |
| 2015/0223536 | A1 | 8/2015 | Kim et al. | |
| 2015/0223537 | A1 | 8/2015 | Kim et al. | |

* cited by examiner

*Primary Examiner* — Fenn C Mathew
*Assistant Examiner* — Cynthia Collado
(74) *Attorney, Agent, or Firm* — Venable LLP; Steven J. Schwarz; Kerri M. Patterson

(57) ABSTRACT

A combination for supporting a hair extension may include a package including a plastic sheet and stabilizing material, and a hair extension including strands of hair including a root end and a tip end and a weft track. Each strand of hair may be attached along a length of the weft track by the root end, wherein the weft track may be removably attached to the plastic sheet, the strands of hair may be wound around the stabilizing material, and the stabilizing material may prevent movement of the strands of hair.

23 Claims, 7 Drawing Sheets

HAIR ROLL-UP PACKAGE

RELATED APPLICATIONS

This application claims the benefit of U.S. Provisional Application No. 62/145,256, filed Apr. 9, 2015, which is incorporated herein by reference in its entirety.

BACKGROUND

Field of Invention

Embodiments relate to packaging hair wefts and more generally to hair storage and shipment products.

SUMMARY

Aspects of the invention may include packages and methods. In one embodiment of the invention, a combination for supporting a hair extension may be described. The combination may include a package, including a plastic sheet and an anti-static stabilizing material. The combination may also include a hair extension including a plurality of strands of hair, each strand of the plurality of strands of hair comprising a root end and a tip end, and a weft track, wherein each strand of the plurality of strands of hair is attached along a length of the weft track by the root end, wherein the weft track is removably attached to the plastic sheet, the plurality of strands of hair being wound around the stabilizing material, the stabilizing material preventing movement of the plurality of strands of hair In another embodiment, a method for protecting a hair extension may be provided. The method may include attaching the hair extension to a flexible plastic sheet, the hair extension including strands of hair connected to a weft track, the weft track being where the hair is attached to the plastic sheet; preserving or enhancing a curl of the hair extension by furling the hair extension around a stabilizing material, the stabilizing material reducing movement between the strands of hair, the furling preserving or enhancing a curl of the hair extension; and preventing contamination of the hair extension by sealing the hair extension and plastic sheet using plastic wrap, the plastic wrap being wrapped around the plastic sheet.

In yet another embodiment, a package may be provided. The package may include a plastic sheet having a first end and a second end, the first end including at least one perforation in the plastic sheet; an anti-static stabilizing material; and a hair product having at least one strip, wherein a plurality of hair strands radiate from the at least one strip, the at least one strip being secured to the plastic sheet at the at least one perforation, wherein the hair product and the plastic sheet are wound at least once around the anti-static stabilizing material. The packaging may further include plastic wrap wrapped around the plastic sheet, hair product, and anti-static stabilizing material. The plastic sheet may be the same size or larger than the hair product and may protect the hair product from contaminates. The hair product and the plastic sheet being wound at least once around the anti-static stabilizing material may preserve or enhance a curl of the hair product.

BRIEF DESCRIPTION OF THE DRAWINGS

The foregoing and other features and advantages of the invention will be apparent from the following, more particular description of various exemplary embodiments, as illustrated in the accompanying drawings wherein like reference numbers generally indicate identical, functionally similar, and/or structurally similar elements. The first digits in the reference number indicate the drawing in which an element first appears.

DESCRIPTION OF THE EMBODIMENTS

Exemplary embodiments are discussed in detail below. While specific exemplary embodiments are discussed, it should be understood that this is done for illustration purposes only. In describing and illustrating the exemplary embodiments, specific terminology is employed for the sake of clarity. However, the embodiments are not intended to be limited to the specific terminology so selected. A person skilled in the relevant art will recognize that other components and configurations may be used without parting from the spirit and scope of the embodiments. It is to be understood that each specific element includes all technical equivalents that operate in a similar manner to accomplish a similar purpose. The examples and embodiments described herein are non-limiting examples.

All publications cited herein are hereby incorporated by reference in their entirety.

As used herein, the term "a" refers to one or more. The terms "including," "for example," "such as," "e.g.," "may be" and the like, are meant to include, but not be limited to, the listed examples.

In the exemplary embodiments, a "wig" can include an easily detachable manufactured covering of natural or synthetic hair for the head. A "hair piece" could be natural or synthetic hair which is either woven or otherwise attached to a user's natural hair for long term use or detachable attachment for short term use, commonly termed a weave or extension. A "weft" can include a collection of multiple strands of natural or synthetic hair (e.g., attached together by intricate stitched work with a sewing machine or fused together by glue and woven material) which is treated as a unit in the manufacture and styling (e.g., making) of a wig or hair piece. A "weft track" can include a strip (e.g., stitched or fused section) to which wefts (e.g., strands) of hair may be attached. A "root end" can include the end of hair which is stitched, fused together or otherwise attached to the weft track, which may be attached, for example, to a wig supporting fabric or base cap, or to the user's natural hair in the case of a hair piece. A "tip end" can include the opposite ends of the strands of hair or weft which is not attached, for example, to the wig or hair piece supporting fabric or base cap or to user's natural hair. A "closure hair piece" can include a hair piece that is usually located on the top of the head and used as a finalizing piece to cover, for example, exposed root ends of one or more weft tracks.

Wigs, wefts, and/or hair pieces (referred to herein as "hair") may provide added confidence to individuals who wear the hair. However, hair may be susceptible to environmental factors (e.g., dust, heat, liquid, etc.) and hair may be designed with a particular form, shape, or shapes. Accordingly, what is needed is a method or package that may protect hair from environmental damage while retaining a desired shape and form of the hair.

Figure 1:
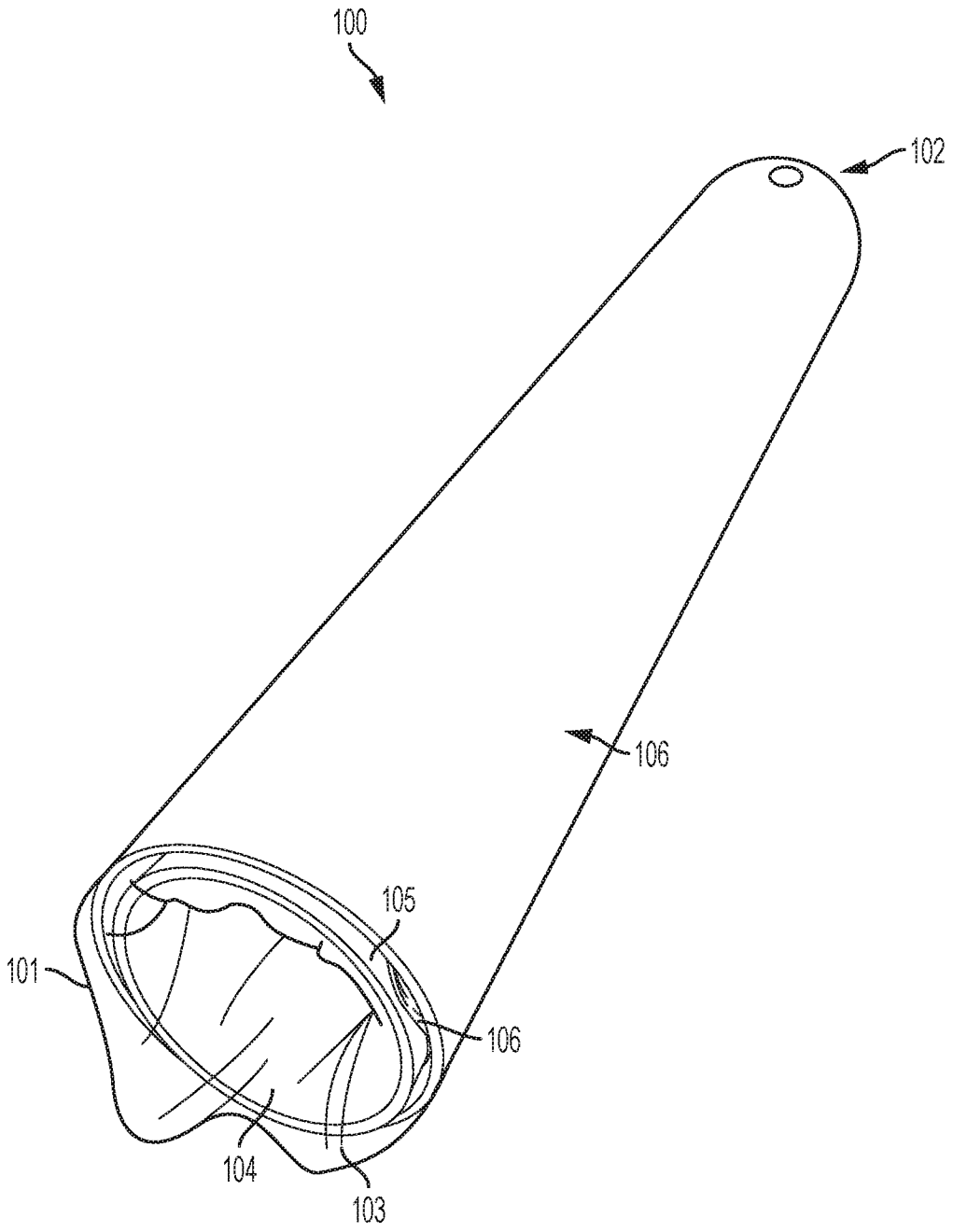
FIG. 1 is an example hair package containing hair extension/wefts or strands of hair and protective packaging in an embodiment of the invention.

FIG. 1 depicts example package 100 containing hair extension/wefts or strands of hair. Example package 100 may include plastic sheet 101, item description 102, plastic wrap 103, tube 104, stabilizing material 105, and weft hair extension (hair) 106. Plastic sheet 101 may be a clear sheet of flexible plastic on which weft hair extension 106 may be wrapped. In an embodiment where plastic sheet 101 and plastic wrap 103 are transparent, hair 106 may be seen through plastic sheet 101 and plastic wrap 103. Hair 106 may be attached or secured to plastic sheet 101. Plastic sheet 101 may protect hair 106 from various contaminates (e.g., environmental contaminants, dust, liquid, etc.) and may protect hair 106 from damage (e.g., external pressure, dropping, etc.).

Plastic sheet 101 may maintain the shape of the hair 106, for example, during transport and display. Plastic sheet 101 may be made out of, for example, PET (polyethylene glycol terephthalate) or other similar material. Plastic sheet 101 may provide support for package 100, and plastic sheet 101 may comprise a flexible material. The size of plastic sheet 101 may depend on the length and width of hair 106. For example, plastic sheet 101 may be between 8 inches and 16 inches wide, with some embodiments being 13 inches wide (depending on the width of hair 106). Additionally, plastic sheet 101 may be between, for example, 6 inches to 25 inches long, with some embodiments being 9 inches or 20 inches long (depending on, for example, the length of hair 106). Item description 102 may include, for example, a sticker with the style/length of the hair and/or hair source. Plastic wrap 103 may be used to cover plastic sheet 101, and to further protect hair 106 from contaminants (e.g., environmental contaminants, dust, liquid, etc.).

Plastic wrap 103 may be secured in place by an adhesive on each end and with the remaining width tucked into each side of tube 104. Plastic wrap 103 may be made out of, for example, OPP (oriented polypropylene), cellophane, or other similar material. Tube 104 may be a cylindrical tube. Tube 104 may be made out of plastic such as, for example, PET (polyethylene glycol terephthalate) or other material such as polystyrene, polybutadiene, polyethylene, polyurethane, cardboard, or papier-mâché. Tube 104 may be rolled and held in place with an adhesive such as tape, for example. In one embodiment, tube 104 may be solid, in another embodiment, tube 104 may be hollow. Tube 104 may be the same width as plastic sheet 101. Tube 104 may be the same width as hair 106. In an embodiment, tube 104 does not have end pieces. In some embodiments, tube 104 is not included with package 100. Stabilizing material 105 may be used to hold or secure hair 106 in place inside the package, and may prevent or reduce hair static. Stabilizing material 105 may be constructed out of an anti-static and/or soft material, for example, PP (polypropylene), polyethylene, or other similar material, or out of a wood product (e.g., paper).

Stabilizing material 105 may be touching and located around hair 106. Stabilizing material 105 may be attached or secured to tube 104 and/or wrapped or wound around tube 104. In one embodiment, stabilizing material 105 may be between hair 106 and tube 104. Hair 106 may be wrapped or wound around stabilizing material 105 and/or around tube 104. In one embodiment, tube 104 is not present and hair 106 with attached plastic sheet 101 may be rolled up, curled, wound, or furled around stabilizing material 105. The stabilizing material 105 may be, for example, a sheet of fabric.

Hair 106 may include strands of hair that are sewn into a weft. Hair 106 and attached sheet 101 may be rolled, curled, or furled around stabilizing material 105 with or without tube 104. In an embodiment, for example, hair 106 may only be secured or attached to plastic sheet 101 and not to tube 104, and plastic sheet 101 is also not secured or attached to tube 104. Hair 106 may be held in place by plastic sheet 101 and plastic wrap 103. Stabilizing material 105 may reduce static caused by movement of the strands of hair. Stabilizing material 105 may increase friction and reduce the movement of the strands of hair. Hair 106 may be of various sizes such as, for example, 8-16 inches wide and 2 to 18 inches long, with some embodiments being 12 inches wide and 2 inches to 10 inches long. Example package 100 may be placed in, for example, a cardboard box, with or without a window, for shipping and display to customers.

Figure 2:
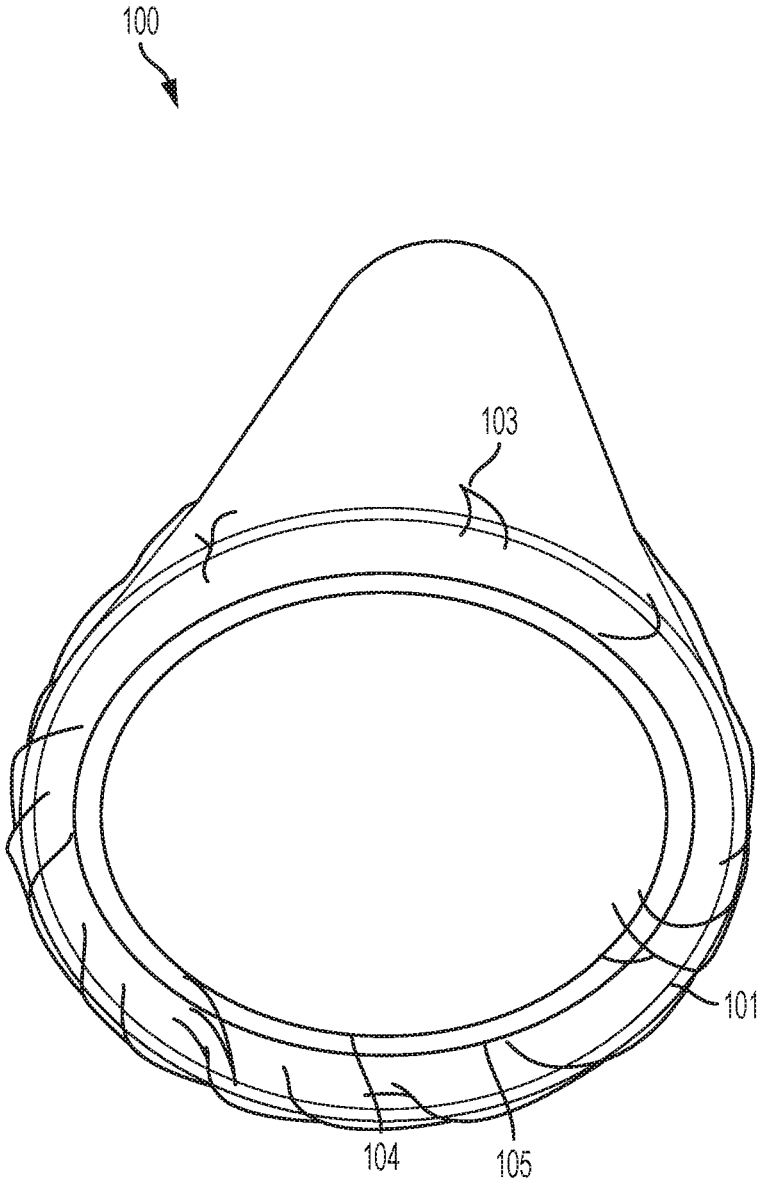
FIG. 2 is an example protective package with the hair extension/wefts or strands of hair removed in an embodiment of the invention.

FIG. 2 depicts a side-view of an example package 100 with hair 106 removed. FIG. 2 depicts plastic sheet 101, plastic wrap 103, tube 104, and stabilizing material 105. Stabilizing material 105 may include a felt like material attached to tube 104.

Figure 3:
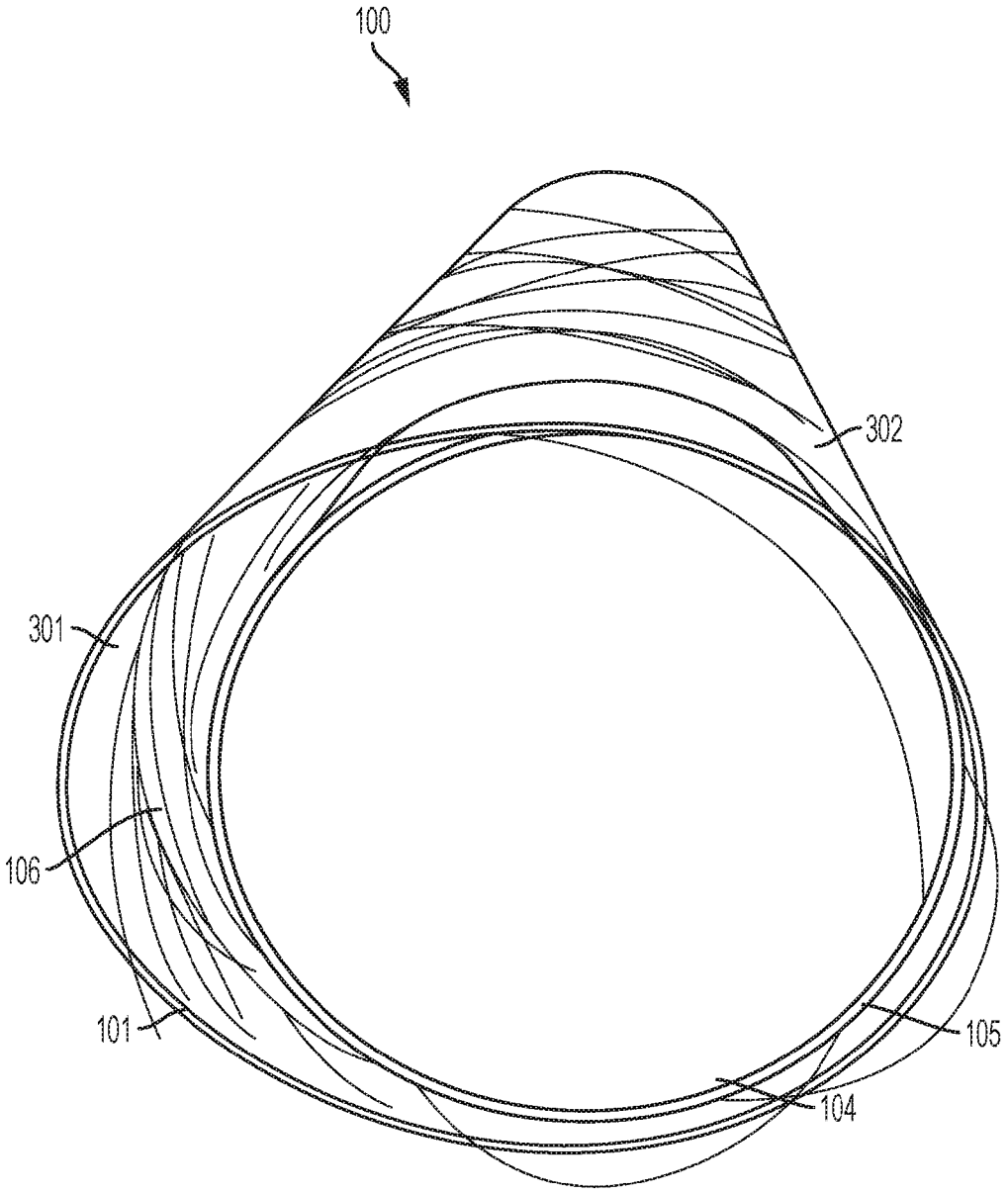
FIG. 3 is an example protective package including the hair extension/wefts or strands of hair with the plastic wrap removed in an embodiment of the invention.

FIG. 3 depicts an example package 100 including hair 106 with plastic wrap 103 removed. FIG. 3 includes plastic sheet 101, tube 104, stabilizing material 105, hair 106, weft track 301, and hair curl 302. Hair 106 may include weft track 301 and curl 302. Weft track 301 may include a top area of hair 106, where, for example, the hair strands may be sewn and held together by one or more threads, for example. Weft track 301 may also include the portion where hair 106 is secured or attached to the plastic sheet 101. Hair curl 302 may include portions of hair 106 that are wrapped or wound around tube 104 and/or stabilizing material 105 to create or maintain a round curl pattern to hair 106.

Figure 4:
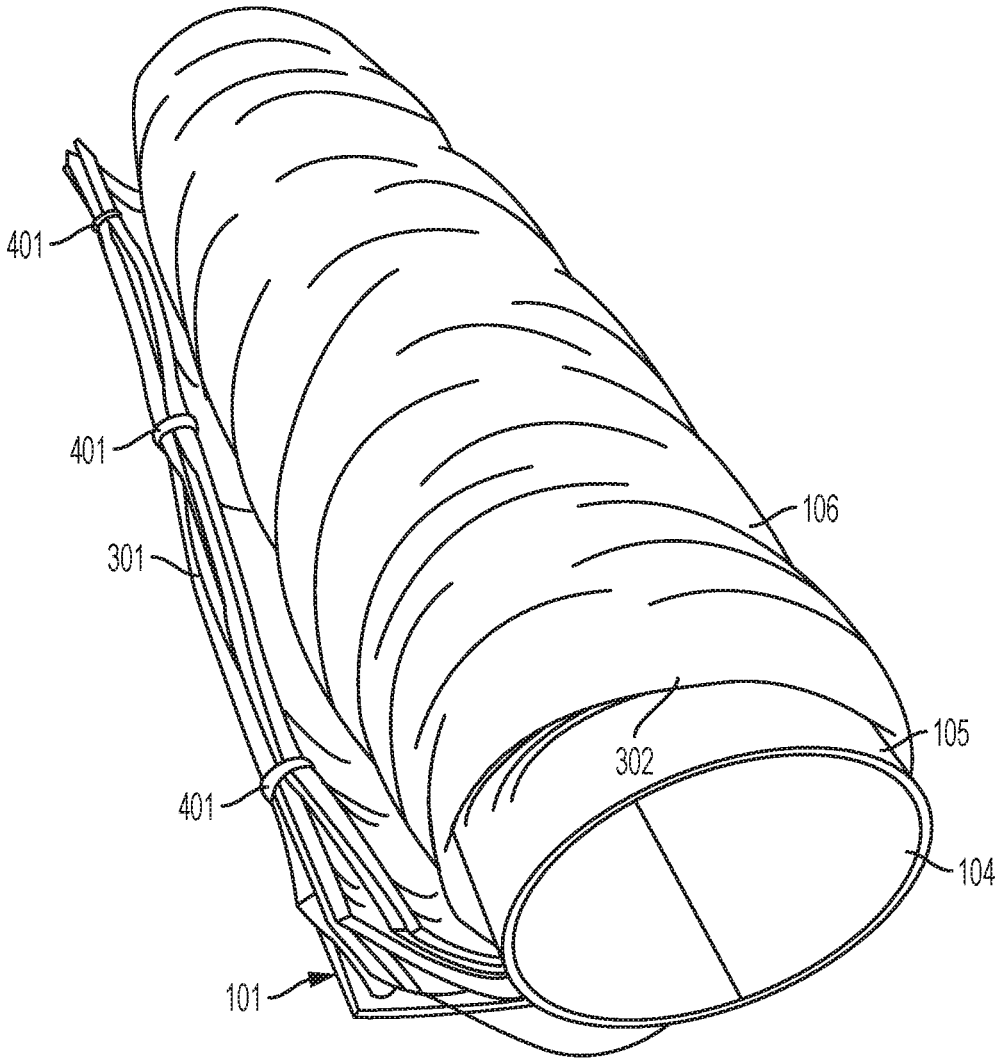
FIG. 4 is an example protective package with the hair extension/wefts or strands of hair with plastic wrap removed in an embodiment of the invention.

FIG. 4 depicts example package 100 including hair 106 with plastic wrap 103 removed. FIG. 4 includes plastic sheet 101, tube 104, stabilizing material 105, hair 106, weft track 301, hair curl 302, and fastener 401. FIG. 4 depicts hair 106 wrapped or wound around stabilizing material 105 and tube 104. In an embodiment, tube 104 may not be present, and hair 106 may be only wrapped or wound around stabilizing material 105. In other embodiments, stabilizing material 105 may be attached to tube 104 with, for example, an adhesive such as tape or epoxy. Fasteners 401 may be used to secure weft track 301 to plastic sheet 101. Weft track 301 may be secured to the plastic sheet at the root end of weft track 301. Fastener 401 may include, for example, one or more rubber bands (e.g., TPU (Thermoplastic polyurethane elastomers)), elastic bands, string, wire, clips, clasps, rings, twist ties, cable ties, or other connector. In the example shown in FIG. 4, plastic sheet 101 is depicted as being connected to weft track 301 at three positions near one end of plastic sheet 101. For example, hair 106 may be secured to plastic sheet 101 at three locations in weft track 301 with fasteners 401. In one embodiment, hair 106 is not secured or attached to tube 104 or stabilizing material 105.

Figure 5:
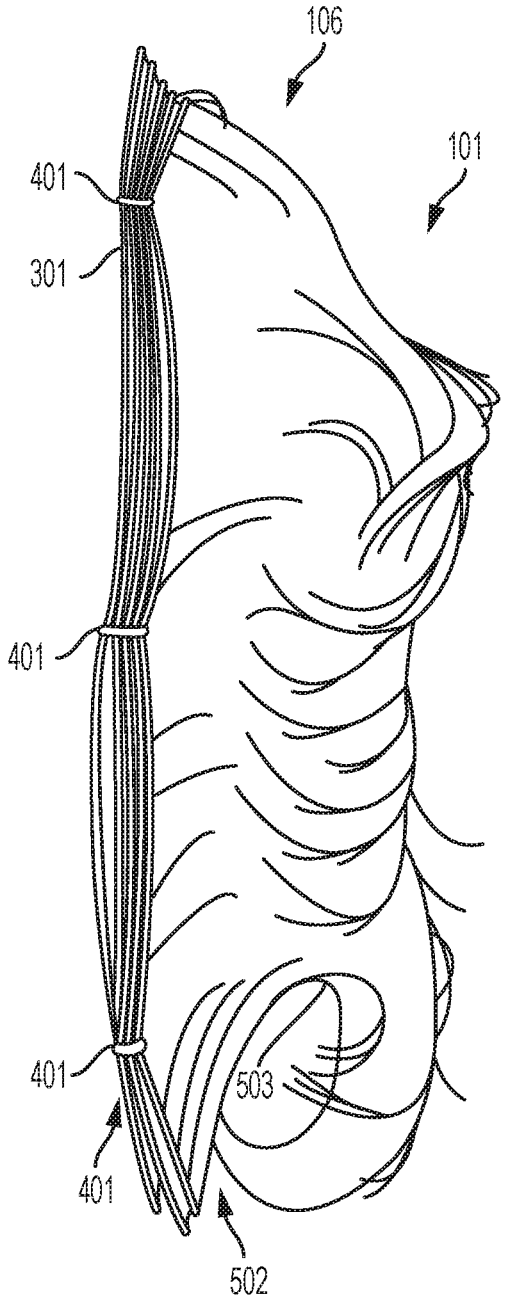
FIG. 5 is an example protective package with the hair extension/wefts or strands attached (e.g., secured) to a clear sheet of material in an embodiment of the invention.

FIG. 5 depicts example hair 106 secured to plastic sheet 101. Plastic sheet 101 may have one or more openings 501 located near one end of plastic sheet 101. Openings 501 made in plastic sheet may be "T" shaped, for example, with the bottom of the "T" still attached to the intact portion of plastic sheet 101. In the example shown in FIG. 5, plastic sheet 101 has three evenly spaced "T" shaped cut outs (e.g., openings 501) at one end of plastic sheet 101, on which fasteners 401 (e.g., rubber bands) may be secured. Fasteners 401 may be connected to plastic sheet 101 by slipping over the top of the "T" shaped cut out. FIG. 5 also depicts tips 502 of hair 106 and bump 503. Tips 502 show an example result of the curl pattern formed and/or preserved and/or enhanced from the packaging and method disclosed herein. Bump 503 also shows an example curve formed on the shaft of hair 106 formed and/or preserved from the packaging and method disclosed herein.

Figure 6:
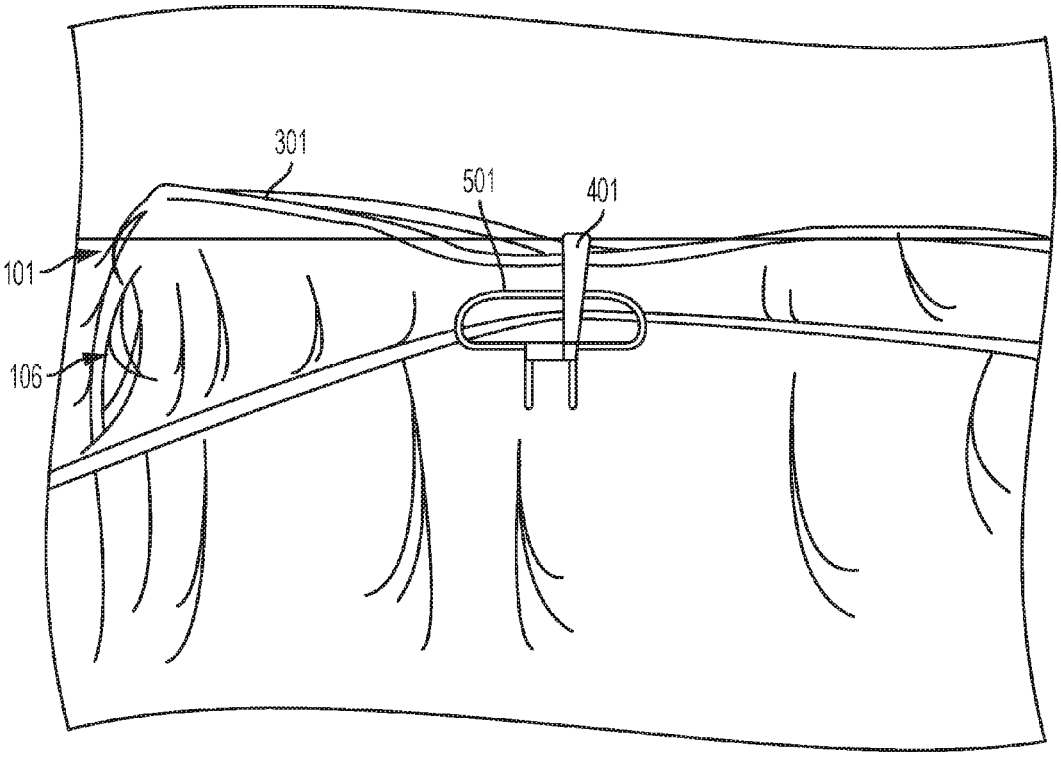
FIG. 6 is an example hair extension/wefts or strands attached to the clear sheet of material in an embodiment of the invention.

FIG. 6 depicts example hair 106 attached or secured to plastic sheet 101. Opening 501 is shown as a "T" shaped cut out with the cross section of the "T" being partially separated from the rest of plastic sheet 101 and the bottom section of the "T" remaining attached to the rest of the plastic sheet 101. Fastener 401 may be connected to, for example, the bottom portion of the "T" and the cross section of the "T" may prevent fastener 401 from slipping off and/or being disconnected from plastic sheet 101. Fastener 401 may secure plastic sheet 101 to hair 106 at weft track 301.

Figure 7:
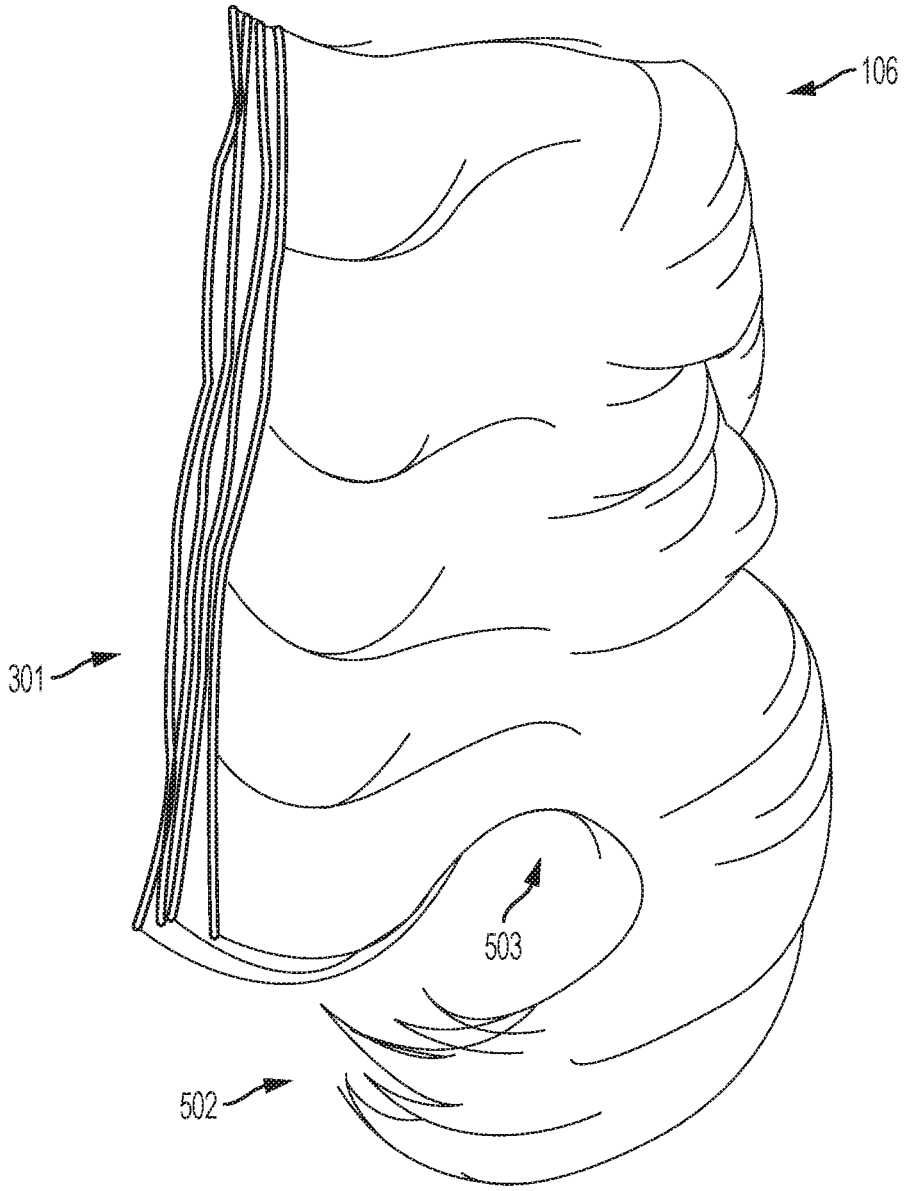
FIG. 7 is an example hair extension/weft or strands of hair removed from the protective package in an embodiment of the invention.

FIG. 7 depicts example hair 106 removed from other parts of packaging 100. The top of hair 106 includes weft track 301, where hair strands may be sewn and held together by, for example, one or more threads. Hair 106 includes hair tips 502 and bump 503. The curl of hair 106 and/or bump 503 may be preserved, formed, and/or enhanced when hair 106 is attached or secured to plastic sheet 101 and wrapped around tube 104 and/or stabilizing material 105.

While various embodiments of the present invention have been described above, it should be understood that they have been presented by way of example only, and not limitation.

What is claimed is:

1. A combination for supporting a hair extension comprising:

a package comprising:

a plastic sheet; and a sheet of anti-static stabilizing material;

a hair extension comprising:

a plurality of strands of hair, each strand of the plurality of strands of hair comprising a root end and a tip end; and a weft track, wherein each strand of the plurality of strands of hair is attached along a length of the weft track by the root end, wherein the weft track is removably attached to the plastic sheet using fasteners, the plurality of strands of hair and the plastic sheet being wound around the sheet of anti-static stabilizing material, the sheet of anti-static stabilizing material preventing movement of the plurality of strands of hair.

2. The combination of claim 1, wherein the packaging further comprises:

a tube, wherein the sheet of anti-static stabilizing material is affixed to the tube, the sheet of anti-static stabilizing material reducing movement of the plurality of strands of hair through friction.

3. The combination of claim 2, wherein the tube comprises polyethylene glycol terephthalate, polystyrene, polybutadiene, polyethylene, polyurethane, cardboard, or papier-mâché.

4. The combination of claim 1, wherein the packaging further comprises:

plastic wrap, wherein the plastic wrap is wrapped around the plastic sheet after the weft track is attached to the plastic sheet and the plurality of strands of hair are wound around the sheet of anti-static stabilizing material.

5. The combination of claim 4, wherein the plastic wrap comprises oriented polypropylene.

6. The combination of claim 1, wherein the fasteners comprise elastic bands.

7. The combination of claim 1, wherein the plastic sheet comprises polyethylene glycol terephthalate.

8. The combination of claim 1, wherein the sheet of anti-static stabilizing material comprises polypropylene or polyethylene.

9. A method for protecting a hair extension comprising:

attaching the hair extension to a flexible plastic sheet using fasteners, the hair extension including strands of hair connected to a weft track, the weft track being where the hair extension is attached to the flexible plastic sheet;

preserving or enhancing a curl of the hair extension by furling the hair extension and plastic sheet around a sheet of anti-static stabilizing material, the sheet of anti-static stabilizing material reducing movement between the strands of hair, the furling preserving or enhancing a curl of the hair extension; and preventing contamination of the hair extension by sealing the hair extension and plastic sheet using plastic wrap, the plastic wrap being wrapped around the plastic sheet.

10. The method of claim 9, wherein the sheet of anti-static stabilizing material is attached to a tube.

11. The method of claim 10, wherein the tube comprises polyethylene glycol terephthalate, polystyrene, polybutadiene, polyethylene, polyurethane, cardboard, or papier-mâché.

12. The method of claim 9, wherein the plastic wrap comprises oriented polypropylene.

13. The method of claim 9, wherein the fasteners comprise elastic bands.

14. The method of claim 9, wherein the plastic sheet comprises polyethylene glycol terephthalate.

15. The method of claim 9, wherein the sheet of anti-static stabilizing material comprises polypropylene or polyethylene.

16. A packaging comprising:

a plastic sheet having a first end and a second end, the first end including at least one perforation in the plastic sheet;

a sheet of anti-static stabilizing material, and a hair product having at least one strip, wherein a plurality of hair strands radiate from the at least one strip, the at least one strip being secured to the plastic sheet at the at least one perforation using a fastener, wherein the hair product and the plastic sheet are wound at least once around the sheet of anti-static stabilizing material.

17. The packaging of claim 16, further comprising a plastic wrap wrapped around the plastic sheet, hair product, and sheet of anti-static stabilizing material.

18. The packaging of claim 16, wherein the plastic sheet is a same size or larger than the hair product.

19. The packaging of claim 16, wherein the plastic sheet covers the hair product and protects the hair product from contaminates.

20. The packaging of claim 16, wherein the hair product and the plastic sheet being wound at least once around the sheet of anti-static stabilizing material preserves or enhances a curl of the hair product.

21. The combination of claim 1, wherein the sheet of anti-static stabilizing material is layered underneath the hair extension.

22. The method of claim 9, wherein the sheet of stabilizing material is layered underneath the hair extension.

23. The packaging of claim 16, wherein the sheet of anti-static stabilizing material is layered underneath the hair product.

* * * * *